US005613670A

United States Patent [19]

Ballestrazzi et al.

[11] Patent Number: 5,613,670

[45] Date of Patent: Mar. 25, 1997

[54] DEVICE UTILIZING A ROTARY DISC HAVING A GRIPPING ELEMENT FOR RAPIDLY FEEDING SHEET INSERTS TO A PUSHER CONVEYOR OF A PACKAGING MACHINE

[75] Inventors: Aris Ballestrazzi; Lamberto Tassi, both of Savignano sul Panaro, Italy

[73] Assignee: Sitma S.p.A., Modena, Italy

[21] Appl. No.: 591,269

[22] Filed: Jan. 25, 1996

[30] Foreign Application Priority Data

Apr. 19, 1995 [IT] Italy ..... MI95A0790

[51] Int. Cl.[6] ..... B65H 5/22

[52] U.S. Cl. ..... 271/3.23; 271/12; 271/225; 271/245; 271/184; 271/196; 270/58.29

[58] Field of Search ..... 271/3.18, 3.21, 271/3.23, 4.12, 11–13, 5, 184, 196, 231, 245, 250, 251, 271; 270/58.29, 58.24, 58.16

[56] References Cited

U.S. PATENT DOCUMENTS

| | | | |
|---|---|---|---|
| 3,556,515 | 1/1971 | Mueller | 271/271 X |
| 3,970,299 | 7/1976 | Berger, Jr. et al. | 271/250 |
| 4,402,497 | 9/1983 | Weibel et al. | 271/11 |
| 4,693,463 | 9/1987 | Schwebel et al. | 271/250 X |
| 5,174,559 | 12/1992 | Diamantides | 271/271 X |
| 5,238,120 | 8/1993 | Ballestrazzi et al. | 271/5 X |
| 5,375,834 | 12/1994 | Rathert | 271/184 X |
| 5,390,909 | 2/1995 | Herrick, Jr. | 271/251 |

FOREIGN PATENT DOCUMENTS

| | | | |
|---|---|---|---|
| 617605 | 8/1935 | Germany | 271/250 |
| 3914964 | 1/1990 | Germany | 271/5 |
| 4125504 | 2/1993 | Germany | 271/250 |
| 479778 | 2/1938 | United Kingdom | 271/250 |

*Primary Examiner*—Boris Milef

*Attorney, Agent, or Firm*—Oblon, Spivak, McClelland, Maier & Neustadt, P.C.

[57] ABSTRACT

A device for rapidly feeding sheet inserts to a pusher conveyor of a packaging machine having upstream of the device a feeder for feeding sheet inserts one after another in a direction essentially perpendicular to the pusher conveyor, including at least one rotary disc provided with at least one element for gripping the sheet insert, the at least one gripping element being operable selectively to lock the sheet insert onto the disc and drag the sheet insert from a position aligned with the insert feeder to an advanced position on the pusher conveyor by causing the sheet insert to undergo a rototranslational movement, the relative drive mechanism for the disc, for the sheet insert feeder and for the pusher conveyor being correlated in their movement.

26 Claims, 4 Drawing Sheets

DEVICE UTILIZING A ROTARY DISC HAVING A GRIPPING ELEMENT FOR RAPIDLY FEEDING SHEET INSERTS TO A PUSHER CONVEYOR OF A PACKAGING MACHINE

BACKGROUND OF THE INVENTION

Field of the Invention

This invention relates to a device for rapidly feeding sheet inserts to a pusher conveyor of a packaging machine.

In machines for packaging flat products of a graphic or editorial type, such as sheets, signatures, magazines, brochures etc., these products, known hereinafter for convenience as "sheet inserts", have to be fed, for example, individually onto a conveyor. The conveyor conveys them to a unit for their packaging within a plastics film or a suitable paper sheet. Such inserts mostly require to be fed in a certain additional number to a base product, a high operating rate being essential.

Up to the present time so-called drum feeders have been used positioned to the side of the pusher conveyor of the collection line, to feed the individual inserts onto the editorial base product. By using a certain number of drum feeders for single inserts or sheet elements positioned one after another, the required product containing a number of such inserts is gradually formed. Such an arrangement has certain technical drawbacks.

In this respect, the fact of laterally positioning drum feeders or other types of feeders means that the single insert or similar fed product reaches the collection conveyor in a perpendicular direction at 90° to the direction of movement of the pushers which advance with the conveyor. In such a case there is a sudden directional change of the fed product, resulting in a reduction in production rate proportional to the type of product collected by the conveyor. This reduction is due both to problems of possible product damage and to problems of correct feed to each individual pusher, because, for example, the product has to be added to and superposed on another which has already been moved forward by the advancing pushers.

If the inserts are light in weight or are of little rigidity, this problem becomes even more serious because of the danger of damage and the poor stability of the insert if fed to the conveyor at high speed.

In general, feeding the various inserts at 90°, whether they are to be added to others or not, requires a pitch between one pusher and the next which is sufficiently large to prevent interference arising on lateral insertion which would prevent the sheet inserts assuming their correct position. This also influences the maximum advancement speed, resulting in a potential production loss and an increase in production costs.

SUMMARY OF THE INVENTION

An object of the present invention is to achieve the fastest possible feed of sheet inserts to a pusher conveyor of a packaging machine.

A further object is to correctly achieve this feed both for rigid, heavy inserts or the like, and for lightweight or flexible inserts.

These objects are attained according to the present invention by a device for rapidly feeding sheet inserts to a pusher conveyor of a packaging machine comprising upstream of said device a feeder for feeding sheet inserts one after another in a direction essentially perpendicular to said pusher conveyor, characterised by comprising at least one rotary disc provided with at least one element for gripping said sheet insert, said at least one gripping element being operable selectively to lock said sheet insert onto said disc and drag said sheet insert from a position aligned with said insert feeder to an advanced position on said pusher conveyor by causing the sheet insert to undergo a rototranslational movement, the relative drive means for said disc, for said sheet insert feeder and for said pusher conveyor being correlated in their movement.

BRIEF DESCRIPTION OF THE DRAWINGS

The characteristics and advantages of a device for rapidly feeding sheet inserts to a pusher conveyor of a packaging machine according to the present invention will be more apparent from the following description given by way of a non-limiting embodiment with reference to the accompanying schematic drawings, in which.

DESCRIPTION OF THE PREFERRED EMBODIMENTS

Figure 1:
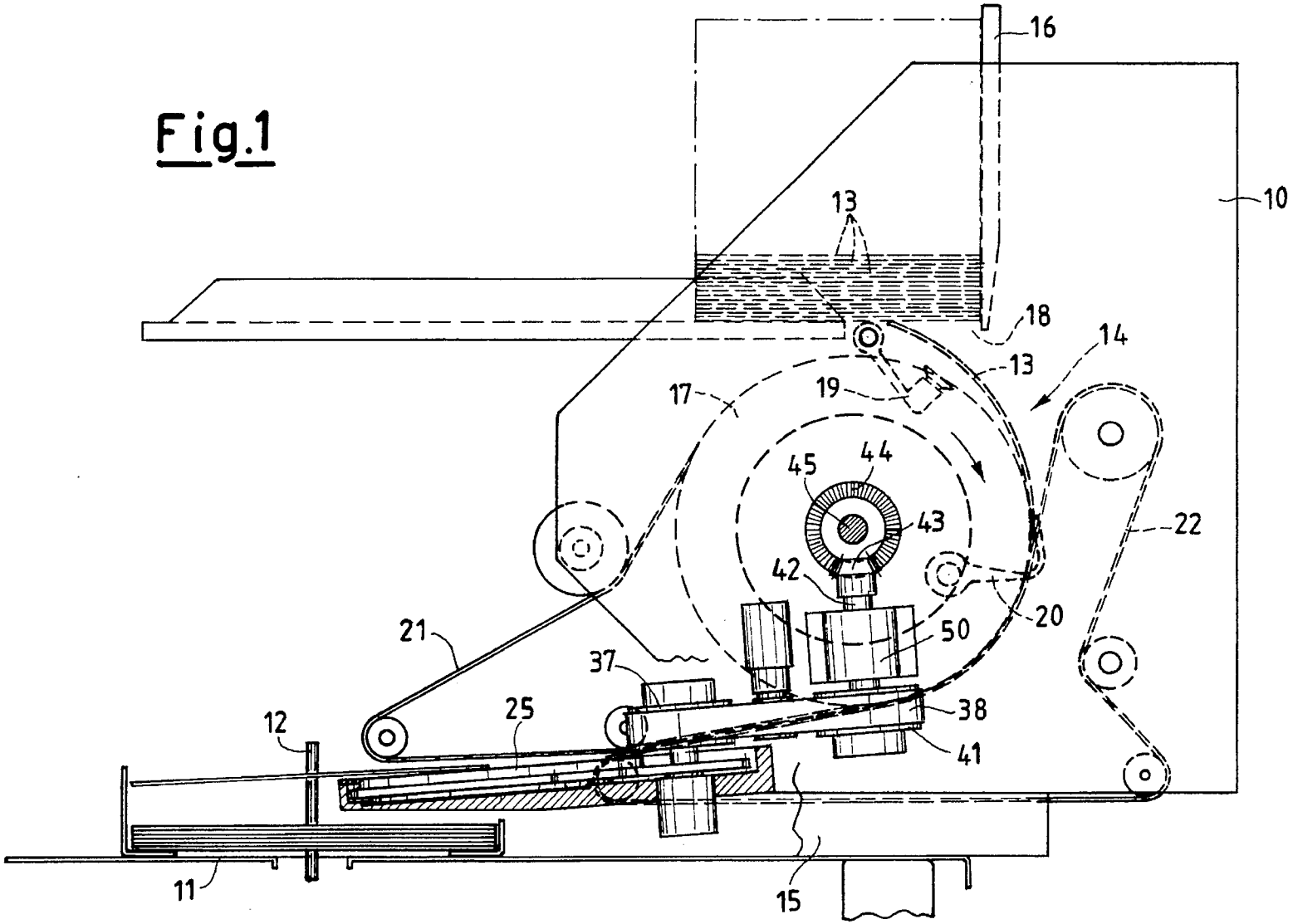
FIG. 1 is a partly sectional schematic side view of a drum feeder provided with a device according to the present invention and associated with a pusher conveyor.
Figure 2:
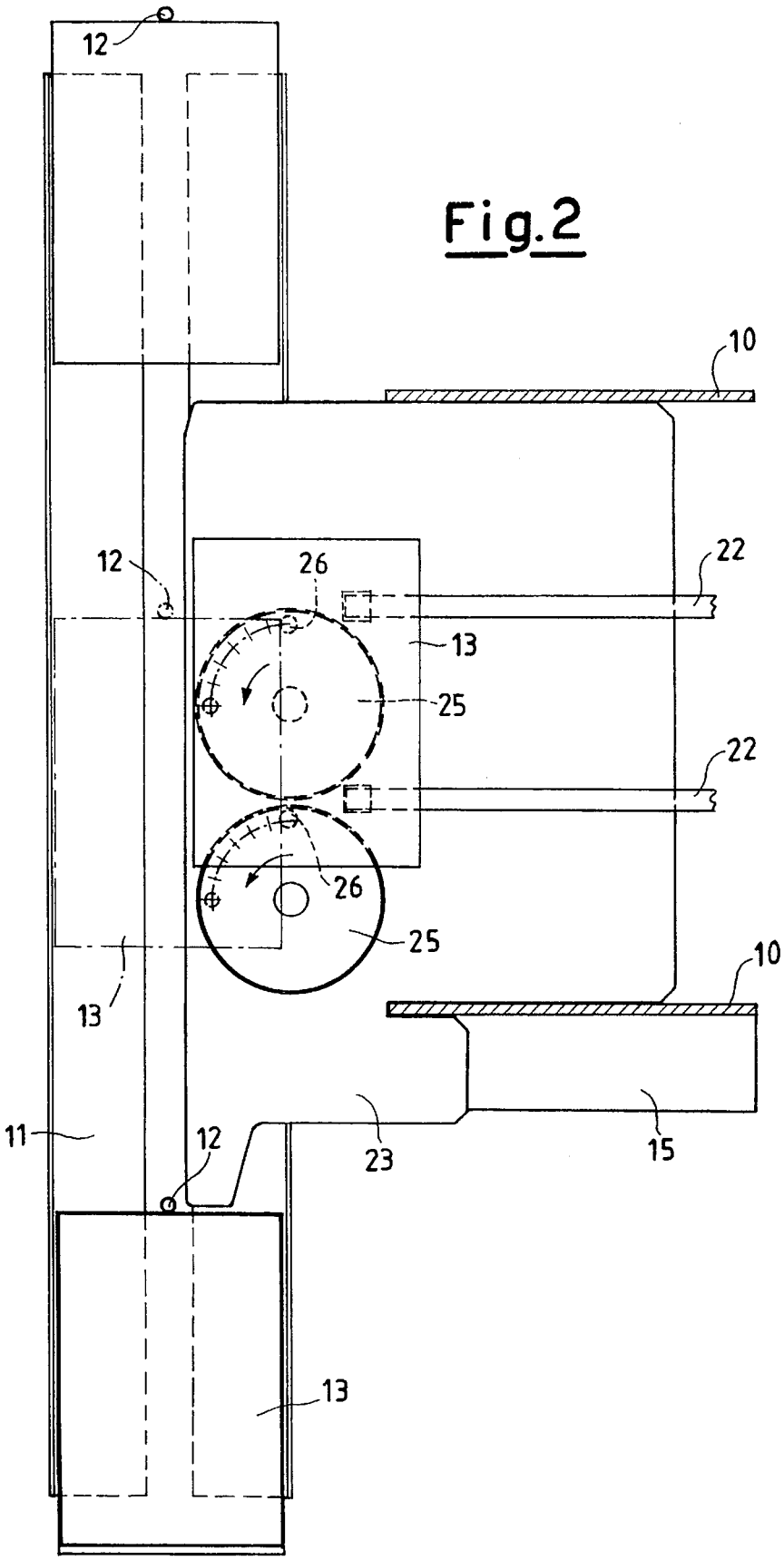
FIG. 2 is a plan view from above of the device and conveyor, and showing a belt which collaborates with the drum feeder.
Figure 3:
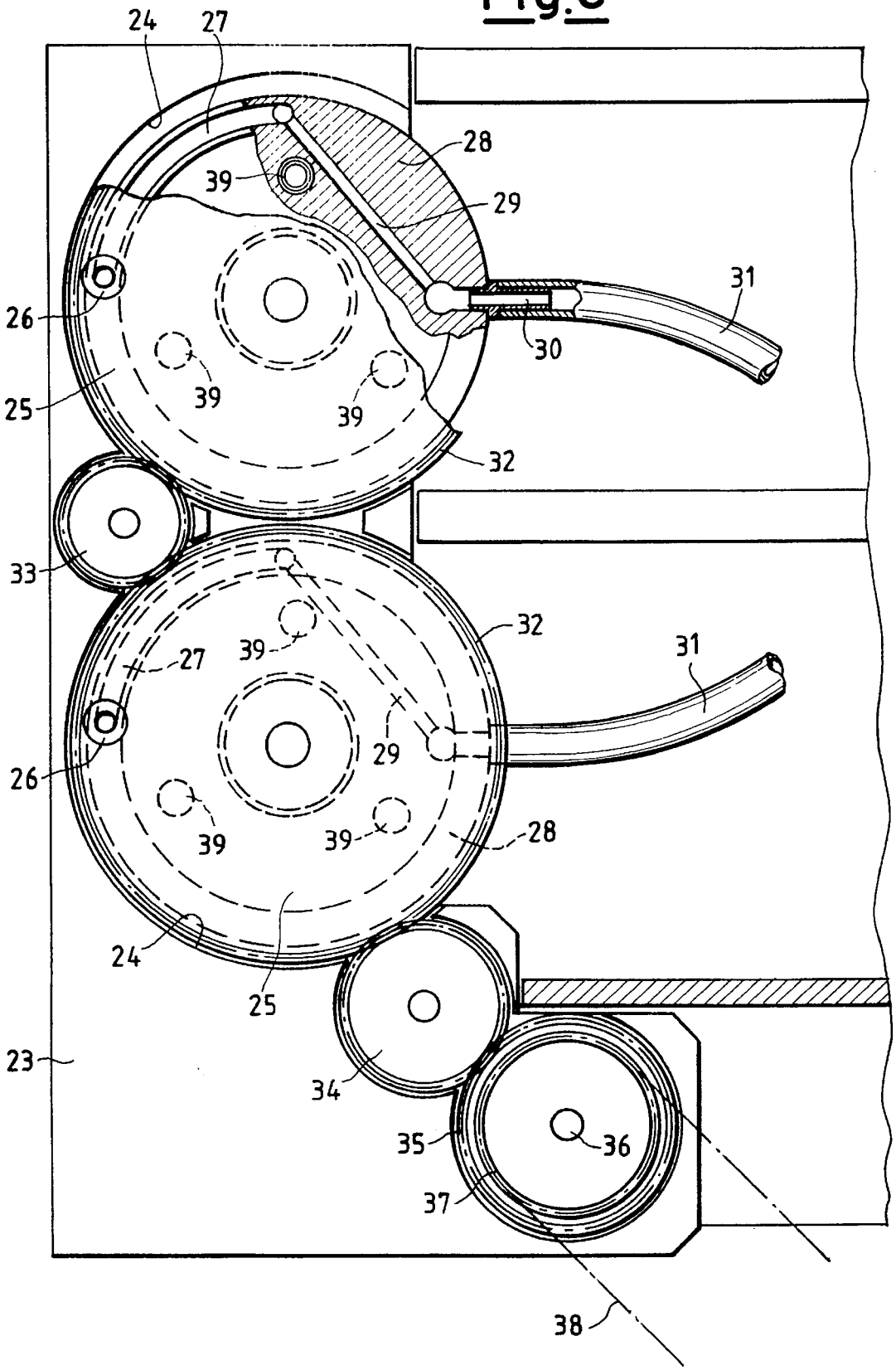
FIG. 3 is a partly sectional enlarged plan view from above of a detail of FIG. 2, in which the device of the present invention can be seen.
Figure 4:
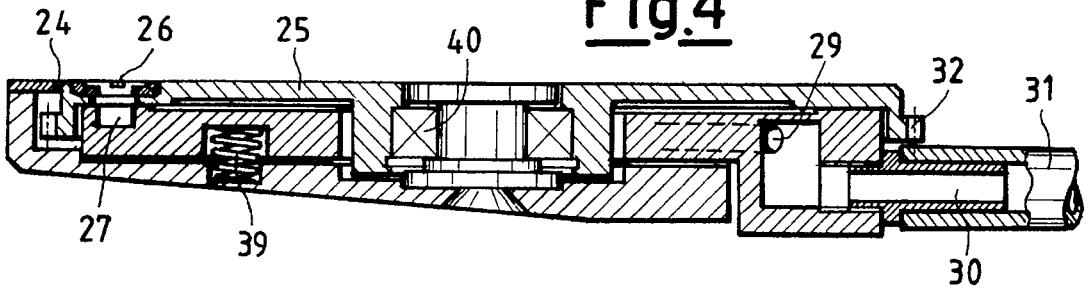
FIG. 4 is a cross-section through a disc shown in FIG. 3.

FIGS. 1 and 2 show part of a packaging apparatus comprising a conveyor which comprises a channel 11 within which a plurality of pushers slide so as to form a pusher conveyor 12, for example, driven by an underlying chain not shown. The channel 11 receives a series of sheet inserts 13, for example from a plurality of lateral drum feeders 14, of which only one is shown, and this only partially.

Between the pusher conveyor 12 and the drum feeder 14 there is provided a device for rapidly feeding sheet inserts 13 formed in accordance with the invention.

A device according to the invention is positioned within the main frame 15 of the conveyor 11, 12 or packaging apparatus, to the side of the conveyor channel 11 along which the graphic and/or editorial products advance. In the illustrated example this rapid feed device is located below the drum feeder 14. The drum feeder 14 is bounded by two walls 10 and comprises, for stacked inserts 13, a container 16 positioned above one or more drums 17 for withdrawing the individual inserts 13 and transporting them towards the conveyor.

At a base aperture 18 in the container 16 there is positioned at least one withdrawal element in the form of suckers 19 which engage the lower surface of the insert 13 and, by rotating, withdraw it from the container and place it against the rotating outer surface of the one or more drums 17. These carry gripping elements 20 of a gripper type, which receive the insert from the suckers 19 and retain it on the drum during rotation.

The insert 13 is then received between pairs of upper guide belts 21 and lower guide belts 22, which are mutually superposed to contain the inserts 13. The guide belts 21 and 22 rotate together with the drums 17, and drag the inserts towards a device according to the invention.

The device for rapidly feeding the inserts 13, located within the frame 15, comprises a base plate 23 positioned nearly at the base of the two walls 10 and provided, in the illustrated example, with two seats 24 for accommodating a pair of discs 25. The two discs 25 rotate and are provided with a sucker 26 housed in the upwardly facing surface of the disc and connectable to a vacuum source. In the seat 24 in the base plate 23 there is located a fixed backing disc 28, for example of an antifriction and/or self-lubricating material, which is maintained in contact with the rotary disc 25 by elastic elements 39. In that surface facing the respective disc 25, the backing disc 28 is provided with a recess 27 extending through a certain arc, for example up to 90°. The recess 27 is connected at one end to an internal channel 29 which extends as far as a fixed connector 30 for connection to a tube 31 from the vacuum source.

Each disc 25, rotatably supported on central bearings 40, comprises, in a region below the surface of the base plate 23, peripheral toothing 32 its rotation. For this purpose two idle gearwheels 33 and 34 are located in the base plate 23, the first gearwheel 33 being interposed between the toothings 32 of the two discs so as to cause them to rotate in the same direction. The second idle gearwheel 34 engages the toothing 32 of one of the discs 25 and is rotated by a further gearwheel 35. The gearwheel 35 is located on a shaft 36 carrying coaxially a toothed pulley 37 rotated by a toothed belt 38 arranged mechanically to rotate in synchronism with the possible drum feeders 14, guide belts 21 and 22 or similar units which feed the inserts one after another in a direction perpendicular to the pusher conveyor.

The suckers 26 are snap-fitted into their seats and are free to rotate so as not to create problems of damage to the insert on which they engage. To achieve a better grip the suckers 26, of plastics construction, can for example comprise cross-recessed suction surfaces.

Consequently the insert 13 which, contained between the two guide belts 21 and 22, arrives on the base plate 23 is engaged by the two suckers 26 of the two discs 25 in the position shown by full lines in FIG. 2. As the discs 25 are rotated by the relative gearwheels as stated, the insert 13, now positioned and locked, is moved with rototranslational movement into its final position, shown by dashed and dotted lines in FIG. 2. In this manner, besides being directed into the channel 11, the insert 13 is made to advance in the same advancement direction as the conveyor pushers 12.

When the insert 13 reaches its aligned position within the channel 11, the suckers 26 disengage the insert or sheet element 13. In this respect the suckers 26, rotating with the discs 25, firstly reach the initial end of the recess 27, ie the initial position indicated by full lines in FIG. 2. They then lie over the initial end of the recess 27, to become connected to vacuum and suck the insert to lock it on the disc. As rotation continues, after about 90° the suckers 26 reach the final end of the recess 27 and are consequently disconnected from the vacuum source, so releasing the insert 13.

Alternatively, the suckers 26 could be located fixed relative to the disc 25. In this case a single disc can be used and the insert be rotated through 90°, such positioning for example being required relative to the pusher conveyor. With a single disc and a single sucker it is hence also possible to maintain the arrival position of the insert 13 for example by providing a cam mechanism which, on rotating the disc through 90°, rotates the sucker in the same direction to maintain the direction of the insert.

A device according to the present invention hence enables the time involved in moving the insert to be also used for advancing it in the direction of advancement of the collection conveyor. Besides enabling the entire apparatus to operate at an increased rate, this particular arrangement enables the individual pushers 12 to be positioned one after another at a smaller distance apart than in known conveyors used up to the present time.

Figure 5:
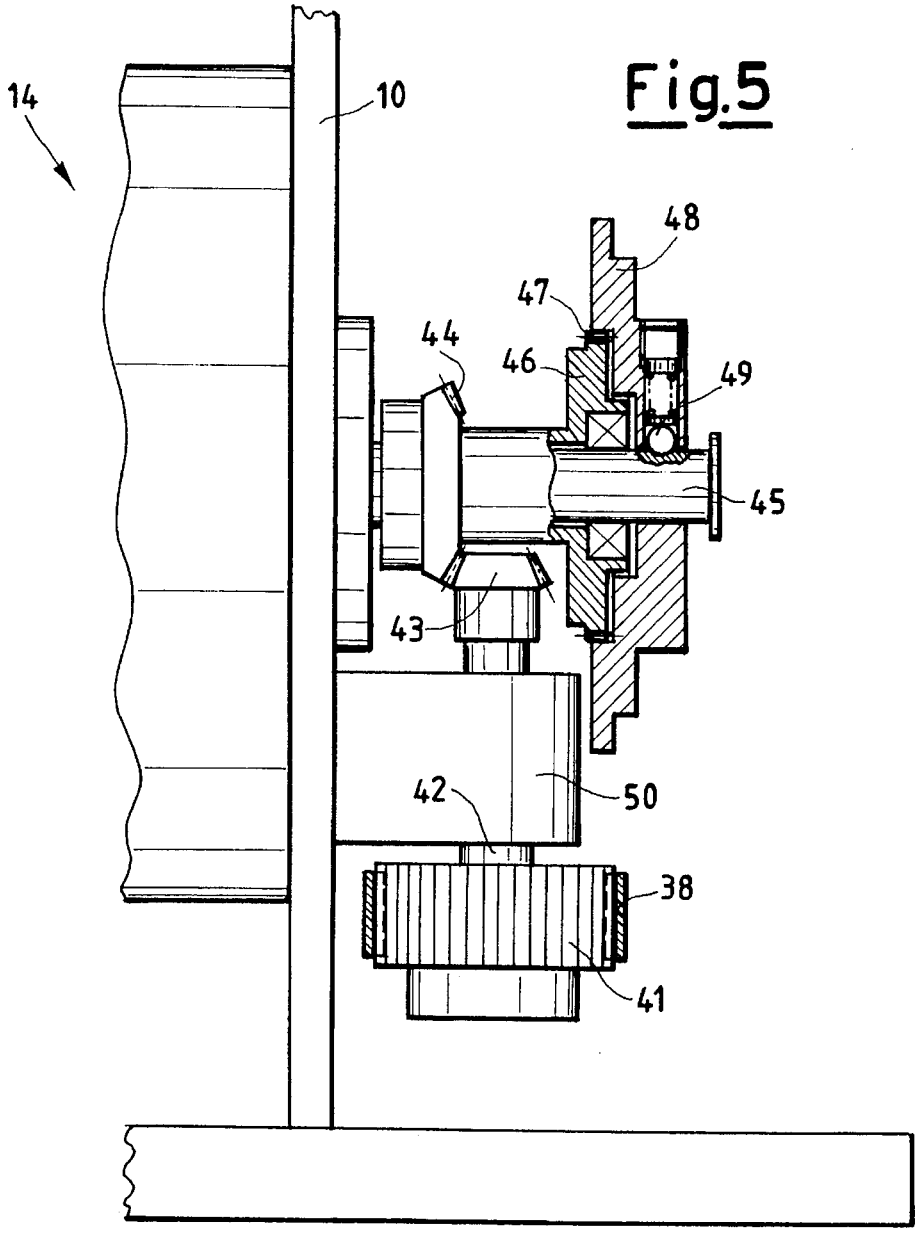
FIG. 5 is a partly sectional enlarged view of the disc drive region, which comprises a disc phasing unit.

FIG. 5 is an enlarged partly sectional view of the disc drive region which also advantageously comprises a phasing unit for the discs. In this manner the positions of the suckers relative to the inserts being fed can be coordinated to further improve the feed.

In this respect, the toothed belt 38 is rotated by a toothed pulley 41 positioned on a shaft 42 contained within a support 50 rigid with a wall 10 of the drum feeder or with the frame 15. Rigid with the shaft 42 there is a bevel gear 43 driven by a second bevel gear 44 rotating on a shaft 45. An extension or bush 46 fixed to the second bevel gear 44 also supports a further gear 47 engagable with a gear 48 comprising complementary internal toothing. This latter can be made to securely engage the shaft 45 by a locking pin arrangement indicated schematically by 49. By disengaging the locking pin 49 from the shaft 45 the internal gear 48 can be withdrawn from the gear 47 to enable it to rotate freely. This also determines the rotation of the bevel gear pair 44, 43, the shaft 42, the toothed belt 38, the various gearwheels 35, 34, 33 and consequently the discs 25 by means of their toothings 32. Having achieved the angular phasing of the discs 25 and consequently of the relative suckers 26, to the extent necessary to delay or to anticipate the sucker suction on the insert 13, the internal gear 48 is re-engaged with the complementary externally toothed gear 47. The locking pin 49 is then re-engaged with the drive shaft 45 to consequently achieve mechanically synchronized movement of the various elements.

As already stated, the transfer of the insert or a similar sheet element from the drum feeders or from any other feeder, for example consisting simply of pairs of superposed belts, hence occurs without any stressing and moreover with the same direction of advancement as the collection conveyor. This continuous transfer motion achieved by the collaboration between the discs and the suckers means that light, flexible, delicate or other such products can be fed to the conveyor, which can advantageously have a smaller pitch between one pusher and the next.

All these arrangements of the present invention result in an increased production rate with consequent lowering of packaging costs, while always achieving correct packaging.

It must be emphasized that a device according to the present invention can be advantageously used for rapidly feeding the sheet inserts 13 comprising graphic and/or editorial products, such as single sheets, signatures, magazines, brochures and the like, sewn or not sewn, in any prechosen number.

We claim:

1. A device for rapidly feeding sheet inserts to a pusher conveyor of a packaging machine, which comprises:

a feeder feeding sheet inserts one after another in a direction substantially perpendicular to said pusher conveyor;

a pair of rotary discs each of which is provided with a substantially flat surface which is substantially parallel to the inserts and each includes at least one suction element gripping said sheet inserts by suction, said at least one gripping element being selectively operable to lock said sheet inserts onto each of said discs and drag said sheet inserts by suction from a position aligned with said insert feeder to an advanced position on said pusher conveyor by causing the sheet inserts to undergo a rototranslational movement due to synchronized movement of said discs, and drive means for each of said discs, for said sheet insert feeder and for said pusher conveyor wherein movement of said discs, said sheet insert feeder and said pusher conveyor are synchronized.

2. A device as claimed in claim 1, wherein each said at least one gripping element comprises a sucker located on a respective one of said discs.

3. A device as claimed in claim 2, wherein each said sucker is selectively connectable to a vacuum source.

4. A device as claimed in claim 3, which comprises a base plate wherein each said disc is positioned in a seat provided in said base plate and said base plate is located at an exit portion of said sheet insert feeder.

5. A device as claimed in claim 4, wherein said rotary discs are each arranged on a fixed backing disc of an anti-friction material, which is maintained in contact with a respective one of said rotary discs by elastic elements arranged between a respective one of said seats and said backing disc.

6. A device as claimed in claim 5, wherein a surface of each said backing disc is provided with a recess which extends through an arc and is connected at one end to an internal channel which extends to a fixed connector receiving a tube from the vacuum source, said recess being brought into connection with said sucker during rotation of each said rotary disc.

7. A device as claimed in claim 6, wherein each said recess provided in a respective one of said backing discs extends through an arc of up to 90°.

8. A device as claimed in claim 1, wherein movement of each said rotary disc is phased with respect to said sheet insert feeder by means of a freely releasable and adjustable toothed coupling provided with means for locking the toothed coupling to a central drive shaft.

9. A device as claimed in claim 2, wherein each said sucker is respectively rotatable relative to said respective one said disc.

10. A device as claimed in claim 1, wherein said gripping elements of said discs are separate from each other and said discs are caused to rotate simultaneously in the same direction by an interposed mechanical transmission.

11. A device as claimed in claim 1, wherein said sheet insert feeder comprises a drum feeder.

12. A device as claimed in claim 1, wherein said sheet insert feeder comprises at least one pair of superposed belts containing said sheet inserts therebetween.

13. A device as claimed in claim 1, wherein said sheet inserts comprise one of graphic and editorial products.

14. A device for rapidly feeding sheet inserts to a pusher conveyor of a package machine, which comprises:

a feeder feeding sheet inserts one after another in a direction substantially perpendicular to said pusher conveyor;

a pair of rotary disks each of which is provided with a substantially flat surface which is substantially parallel to the inserts and each includes at least one suction element gripping said sheet inserts by suction, said at least one gripping element being selectively operable to lock said sheet inserts onto each of said disks and drag said sheet inserts from a position aligned with said insert feeder to an advanced position on said pusher conveyor by causing the sheet inserts to undergo a rototranslational movement due to synchronized movement of said disks, and a drive mechanism driving each of said disks, said sheet insert feeder and said pusher conveyor, wherein movement of said disks, said sheet insert feeder and said pusher conveyor are synchronized.

15. A device as claimed in claim 14, wherein each said at least one gripping element comprises a sucker located on a respective one of said discs.

16. A device as claimed in claim 15, wherein each said sucker is selectively connectable to a vacuum source.

17. A device as claimed in claim 16, which comprises a base plate wherein each said disk is positioned in a seat provided in said base plate and said base plate is located at an exit portion of said sheet insert feeder.

18. A device as claimed in claim 17, wherein said rotary disks are each arranged on a fixed backing disk of an anti-friction material, which is maintained in contact with a respective one of said rotary disks by elastic elements arranged between a respective one of said seats and said backing disk.

19. A device as claimed in claim 18, wherein a surface of each said backing disk is provided with a recess which extends through an arc and is connected at one end to an internal channel which extends to a fixed connector receiving a tube from the vacuum source, said recess being brought into connection with said sucker during rotation of each said rotary disk.

20. A device as claimed in claim 19, wherein each said recess provided in a respective one of said backing disks extends through an arc of up to 90°.

21. A device as claimed in claim 14, wherein movement of each said rotary disk is phased with respect to said sheet insert feeder via a freely releasable and adjustable toothed coupling provided with a lock mechanism locking the tooth coupling to a central drive shaft.

22. A device as claimed in claim 15, wherein each said sucker is respectively rotatable relative to said respective one said disk.

23. A device as claimed in claim 14, wherein said gripping elements of said disks are separate from each other and said disks are caused to rotate simultaneously in the same direction by an interposed mechanical transmission.

24. A device as claimed in claim 14, wherein said sheet insert feeder comprises a drum feeder.

25. A device as claimed in claim 14, wherein said sheet insert feeder comprises at least one pair of superposed belts containing said sheet inserts therebetween.

26. A device as claimed in claim 14, wherein said sheet inserts comprise one of graphic and editorial products.

* * * * *